US009511401B2

(12) United States Patent
Imanari et al.

(10) Patent No.: US 9,511,401 B2
(45) Date of Patent: Dec. 6, 2016

(54) ENERGY-SAVING DEVICE FOR ROLLING PLANT

(75) Inventors: Hiroyuki Imanari, Tokyo (JP); Kei Kubota, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 126 days.

(21) Appl. No.: 14/240,531

(22) PCT Filed: Aug. 30, 2011

(86) PCT No.: PCT/JP2011/069571
§ 371 (c)(1),
(2), (4) Date: Mar. 21, 2014

(87) PCT Pub. No.: WO2013/030945
PCT Pub. Date: Mar. 7, 2013

(65) Prior Publication Data
US 2014/0202224 A1 Jul. 24, 2014

(51) Int. Cl.
*B21B 45/02* (2006.01)
*B21B 27/10* (2006.01)
(Continued)

(52) U.S. Cl.
CPC ..... *B21B 45/0206* (2013.01); *B21B 37/74* (2013.01); *B21B 45/0218* (2013.01); *B21B 27/10* (2013.01); *C21D 8/0226* (2013.01)

(58) Field of Classification Search
CPC ..... B21B 1/26; B21B 2001/225; B21B 2001/221; B21B 27/10; B21B 2027/103; B21B 31/20; B21B 37/32; B21B 37/44; B21B 37/74; B21B 37/76; B21B 45/0203; B21B 45/0206; B21B 45/0209; B21B 45/0218; B21B 2261/20; B21B 2261/21; C21D 8/0226
(Continued)

(56) References Cited

U.S. PATENT DOCUMENTS

2010/0163205 A1* 7/2010 Seidel ..... B21B 1/463 164/452

FOREIGN PATENT DOCUMENTS

DE 10 2007 058 709 A1 2/2009
JP 54 125161 9/1979
(Continued)

OTHER PUBLICATIONS

Machine Translation of the Description section of JPH11267730 from Espacenet.com.*
(Continued)

*Primary Examiner* — Peter DungBa Vo
*Assistant Examiner* — Joshua D Anderson
(74) *Attorney, Agent, or Firm* — Oblon, McClelland, Maier & Neustadt, L.L.P.

(57) ABSTRACT

A control device for a rolling plant, which is capable of reducing the pouring amount of cooling water by pouring cooling water at timing of high cooling efficiency when a material being rolled is cooled, and thereby being capable of saving the energy consumption. The control device includes a plurality of rolling stands that are arranged in tandem on a rolling line to roll the material being rolled of a metallic material conveyed on the rolling line, and inter-stand cooling systems that are provided between the plurality of rolling stands to pour cooling water onto the conveyed material being rolled. The inter-stand cooling systems are configured so that the pouring amount of cooling water poured from the inter-stand cooling system positioned on the upstream side
(Continued)

on the rolling line is larger, and the pouring amount of cooling water poured from the inter-stand cooling system positioned on the downstream side is smaller.

1 Claim, 12 Drawing Sheets

(51) Int. Cl.
*B21B 37/74* (2006.01)
*C21D 8/02* (2006.01)

(58) Field of Classification Search
USPC ..... 72/1–4, 6.2, 8.5, 11.3, 12.2, 28.2, 29.1, 72/128, 200–202, 234, 342.2, 342.5, 72/342.6, 365.2, 366.2; 700/153
See application file for complete search history.

(56) References Cited

FOREIGN PATENT DOCUMENTS

| | | |
|---|---|---|
| JP | 63 235013 | 9/1988 |
| JP | 3 5013 | 1/1991 |
| JP | 5 317946 | 12/1993 |
| JP | 5 337506 | 12/1993 |
| JP | 6 142733 | 5/1994 |
| JP | 9 329558 | 12/1997 |
| JP | 11-267730 A | 10/1999 |
| JP | 2002 143918 | 5/2002 |
| JP | 2003 136113 | 5/2003 |
| JP | 2004 298888 | 10/2004 |
| JP | 2005 313202 | 11/2005 |
| JP | 2006 272339 | 10/2006 |
| JP | 2008 260047 | 10/2008 |
| JP | 2009 226438 | 10/2009 |
| JP | 2009 248177 | 10/2009 |

OTHER PUBLICATIONS

International Search Report Issued Nov. 15, 2011 in PCT/JP11/069571 filed Aug. 30, 2011.
Extended European Search Report issued Jun. 29, 2015 in Patent Application No. 11871837.8.

* cited by examiner

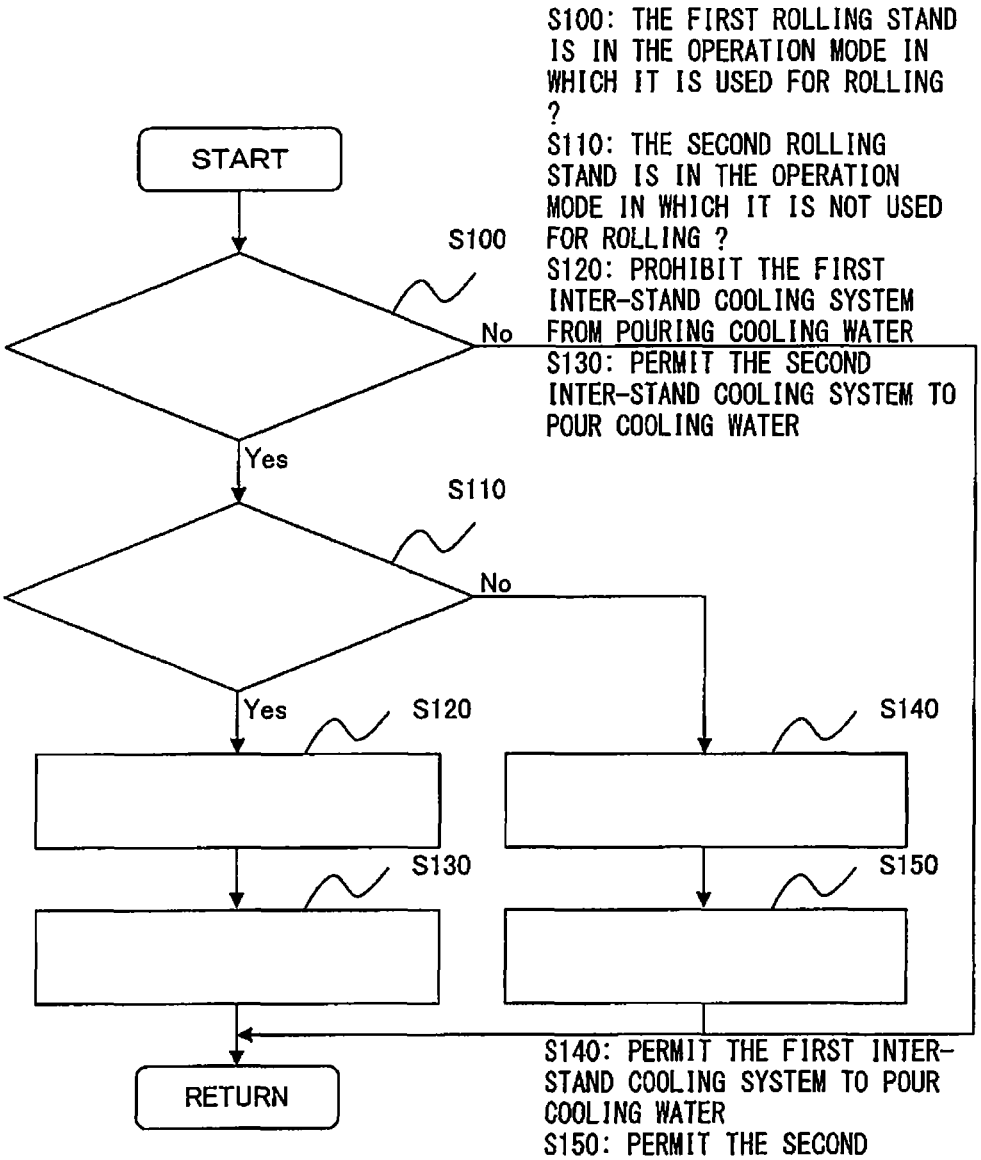

S100: THE FIRST ROLLING STAND IS IN THE OPERATION MODE IN WHICH IT IS USED FOR ROLLING ?

S110: THE SECOND ROLLING STAND IS IN THE OPERATION MODE IN WHICH IT IS NOT USED FOR ROLLING ?

S120: PROHIBIT THE FIRST INTER-STAND COOLING SYSTEM FROM POURING COOLING WATER

S130: PERMIT THE SECOND INTER-STAND COOLING SYSTEM TO POUR COOLING WATER

S140: PERMIT THE FIRST INTER-STAND COOLING SYSTEM TO POUR COOLING WATER

S150: PERMIT THE SECOND INTER-STAND COOLING SYSTEM TO POUR COOLING WATER

Figure 7

ENERGY-SAVING DEVICE FOR ROLLING PLANT

TECHNICAL FIELD

The present invention relates to an energy-saving device for a rolling plant.

BACKGROUND ART

In hot strip rolling and hot plate rolling, cooling water is generally poured onto the material being rolled of a metallic material to control the temperature thereof to a given target temperature. Also, since rolling rolls and table rolls for conveyance come into contact with the material being rolled having a high temperature of about 1000° C., the rolling rolls and the table rolls are generally cooled with cooling water. The cooling water in the latter case is used not only when a high-temperature material is rolled in hot strip rolling and hot plate rolling but also when an ordinary-temperature material being rolled is rolled, for example, in cold rolling.

A rolling plant is provided with a circulation path for cooling water, and the cooling water is frequently used after being pumped up once into a tank at a high place. To move the water, a pump, an electric motor for driving the pump, and a driving device for the electric motor are always used. Therefore, if the circulation of water can be reduced, the energy required for driving the pump can be saved.

For example, Patent Literature 1 (Japanese Patent Laid-Open No. 2006-272339) "Method and Device for Cooling Rolling Roll" discloses a method in which a pump for sending cooling water is operated at a low speed when a material being rolled is absent.

CITATION LIST

Patent Literature

Patent Literature 1: Japanese Patent Laid-Open No. 2006-272339

Patent Literature 2: Japanese Patent Laid-Open No. 2005-313202

Patent Literature 3: Japanese Patent Laid-Open No. 2008-260047

SUMMARY OF INVENTION

Technical Problem

Unfortunately, in the above-described conventional temperature control and in the cooling method disclosed in Patent Literature 1, the viewpoint of how efficiently the material being rolled, rolling rolls, and table rolls are cooled has not been considered. For this reason, the pouring amount of cooling water is large, and the energy required for driving the above-described pump is not saved sufficiently. Therefore, it cannot be said that the energy-saving effect is sufficient.

The present invention has been made to solve the above-described problem, and accordingly an object thereof is to provide a control device for a rolling plant, which is capable of reducing the pouring amount of cooling water by pouring cooling water at timing of high cooling efficiency when a material being rolled is cooled, and thereby being capable of saving the energy consumption.

Also, the present invention has been made to solve the above-described problem, and accordingly an object thereof is to provide a control device for a rolling plant, which is capable of reducing the pouring amount of cooling water by pouring cooling water at timing of high cooling efficiency when table rolls and rolling rolls are cooled in a so-called idling state in which no material is rolled, and thereby being capable of saving the energy consumption.

Solution to Problem

A first aspect of the present invention is an energy-saving device for a rolling plant, comprising:

a plurality of rolling stands which are arranged in tandem on a rolling line to roll the material being rolled of a metallic material conveyed on the rolling line; and inter-stand cooling systems which are provided between the plurality of rolling stands to pour cooling water onto the conveyed material being rolled, characterized in that the inter-stand cooling systems are configured so that the pouring amount of cooling water poured from the inter-stand cooling system positioned on the upstream side on the rolling line is larger, and the pouring amount of cooling water poured from the inter-stand cooling system positioned on the downstream side is smaller.

A second aspect of the present invention is an energy-saving device for a rolling plant, comprising:

a first rolling stand for rolling the material being rolled of a metallic material conveyed on a rolling line;

a second rolling stand arranged on the downstream side of the first rolling stand;

a third rolling stand arranged on the downstream side of the second rolling stand;

a first inter-stand cooling system which is provided between the first rolling stand and the second rolling stand to pour cooling water onto the conveyed material being rolled;

a second inter-stand cooling system which is provided between the second rolling stand and the third rolling stand to pour cooling water onto the conveyed material being rolled;

usage state changeover means capable of changing over the state in which the second rolling stand rolls the material being rolled and the state in which the second rolling stand does not roll the material being rolled; and water-pouring location setting means which prohibits the first inter-stand cooling system from pouring cooling water and permits the second inter-stand cooling system to pour cooling water in the state in which the first rolling stand rolls the material being rolled and the second rolling stand does not roll the material being rolled.

A third aspect of the present invention is an energy-saving device for a rolling plant, comprising:

a plurality of rolling stands which are arranged in tandem on a rolling line to roll the material being rolled of a metallic material conveyed on the rolling line; and inter-stand cooling systems which are provided between the plurality of rolling stands to pour cooling water onto the conveyed material being rolled, characterized in that the inter-stand cooling system is installed at a position close to the entry side of the rolling stand on the downstream side, not at a position on the delivery side of the rolling stand on the upstream side.

A fourth aspect of the present invention is an energy-saving device for a rolling plant, comprising:

a plurality of water pouring devices which are arranged on the downstream side of the final rolling stand to pour cooling water onto a conveyed material being rolled or cooled;

restriction determining means for determining whether or not there is imposed a restriction such that cooling water must be poured from the water pouring devices arranged continuously of the plurality of water pouring devices; and water pouring device interval setting means for setting the water pouring devices for pouring cooling water of the plurality of water pouring devices with one or more intervals being provided if the restriction is not imposed.

A fifth aspect of the present invention is an energy-saving device for a rolling plant, comprising:

table rolls which are provided on a rolling line to convey a material being rolled or cooled;

a plurality of water pouring devices for pouring cooling water toward the table rolls;

determining means for determining whether or not there is formed an idling state in which the table rolls are not conveying the material being rolled or cooled; and idling time water pouring means which causes the plurality of water pouring devices to pour cooling water intermittently toward the table rolls if the idling state is formed.

A sixth aspect of the present invention is an energy-saving device for a rolling plant, comprising:

a rolling roll which is provided at a rolling stand to roll the material being rolled of a metallic material;

a roll cooling system for pouring cooling water onto the rolling roll;

determining means for determining whether or not there is formed an idling state in which the rolling roll is not rolling the material being rolled;

rolling roll power consumption acquiring means for acquiring power consumption for driving the rolling roll at a plurality of operation points in a low-speed rotation region in the idling state;

pump power consumption acquiring means for acquiring power consumption for driving a pump for supplying cooling water to the roll cooling system at a plurality of operation points in the idling state; and operation point selecting means for selecting, in the idling state, from the plurality of operation points, an operation point at which the sum of the power consumption for driving the rolling roll and the power consumption for driving the pump is at a minimum.

Advantageous Effect of Invention

According to these inventions, the heat within the material being rolled and the rolling equipment (rolling rolls and table rolls), which are objects to be cooled, is transmitted to the surface thereof by heat conduction, and the cooling water is poured at timing when the surface temperature of the object to be cooled rises. The larger the difference in temperature between the surface temperature and the cooling water temperature is, the more the cooling efficiency increases. Therefore, according to the present invention, the pouring amount of cooling water can be reduced, and the energy consumption of a pump and the like for the circulation of cooling water can be saved.

BRIEF DESCRIPTION OF DRAWINGS

FIG. 7 is a flowchart of a control routine executed by the control unit according to the second embodiment of the present invention.

DESCRIPTION OF EMBODIMENTS

Figure 1:
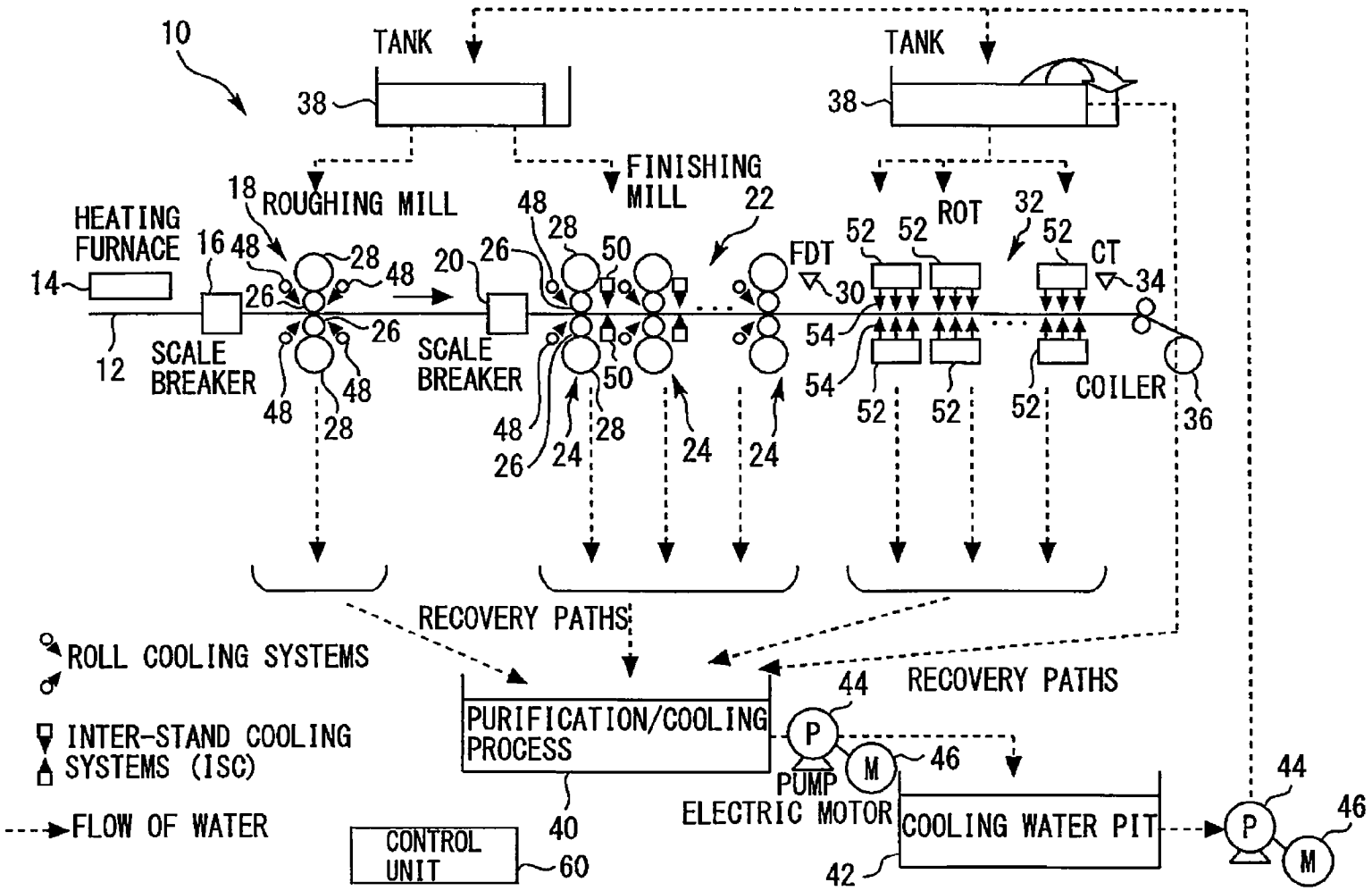
FIG. 1 is an explanatory view for explaining outlines of a hot strip rolling mill and a circulation path of cooling water, which circulation path is used for the hot strip rolling mill.

Embodiments of the present invention will now be described in detail with reference to the accompanying drawings. In the drawings, the same signs are applied to the same or equivalent elements, and the duplicated explanation thereof is omitted.

[Basic Configuration of Rolling Plant]

FIG. 1 is an explanatory view for explaining the basic configuration of a rolling plant. In FIG. 1, a hot strip rolling mill 10 used as one example of the rolling plant, and the outline of the circulation path of cooling water, which circulation path is used for the rolling mill 10, are shown. For convenience of explanation, FIG. 1 shows a hot strip rolling mill; however, the rolling plant to which the present invention is applied is not limited this type. The present invention can be applied to a hot-plate rolling mill and the like in which almost the same circulation system is configured. Also, FIG. 1 shows the circulation system in a simplified form, and in the actual circulation system, a larger number of tanks, pits, pumps, and electric motors are arranged.

On the upstream side on the rolling line of the hot strip rolling mill 10 shown in FIG. 1, a heating furnace 14 is provided to heat a material being rolled 12 of a metallic material. The material being rolled 12 is conveyed from the upstream side (the left-hand side of FIG. 1) to the downstream side (the right-hand side of FIG. 1) on the rolling line by table rolls. On the downstream side of the heating furnace 14, a scale breaker 16 is provided to remove scale on the surface of the material being rolled 12. On the downstream side of the scale breaker 16, a roughing mill 18 for rolling the material being rolled 12 is provided. On the downstream side of the roughing mill 18, a scale breaker 20 is provided. On the downstream side of the scale breaker 20, a finishing mill 22 is provided to roll the material being rolled 12 to the final sheet thickness.

The finishing mill 22 is provided with a plurality of rolling stands 24 arranged in tandem. Each of the rolling stands 24 is provided with work rolls 26, which are rolling rolls rotating while being in contact with the material being rolled 12 to stretch out the material being rolled 12 thin, and backup rolls 28 for correcting the deflection in the rotating axis direction of the work roll 26. The work roll 26 is provided with an electric motor for driving the work roll 26 and a driving device for the electric motor. The backup roll 28 is rotated by the friction between the backup roll 28 and the work roll 26 with the rotation of the work roll 26.

On the downstream side of the finishing mill 22 shown in FIG. 1, a finisher delivery-side pyrometer 30 is provided to measure the temperature of the material being rolled 12 on the finishing mill delivery side (FDT: Finisher Delivery Temperature). On the downstream side of the finisher delivery-side pyrometer 30, a run out table (ROT) 32 is provided. On the downstream side of the ROT 32, a coiling pyrometer 34 is provided to measure the temperature of the material being rolled 12 at the entry side of a coiler (CT: Coiling Temperature). On the downstream side of the coiling pyrometer 34, the coiler 36 is provided to reel the material being rolled 12 in a coil form. Thus, the hot strip rolling mill 10 is configured by the heating furnace 14, the roughing mill 18, the finishing mill 22, the ROT 32, the coiler 36, and the like arranged from upstream toward downstream.

Next, explanation is given of the outline of the circulation path of cooling water for the hot strip rolling mill 10. The broken-line arrow marks in FIG. 1 represent the flow of the circulating cooling water. The hot strip rolling mill 10 is provided with tanks 38 for storing the cooling water, the tanks 38 being provided at positions higher than the roughing mill 18, the finishing mill 22, and the ROT 32. Also, at positions lower than the roughing mill 18, the finishing mill 22, and the ROT 32, recovery paths for cooling water are configured, and are connected to a purification/cooling process 40. The purification/cooling process 40 is connected to a cooling water pit 42 with a pipe. The cooling water pit 42 is connected to the tanks 38 with a pipe. These pipes are provided with pumps 44. Each of the pumps 44 is provided with an electric motor 46 for driving the pump 44, and a driving device for the electric motor 46.

The cooling water that is poured directly onto the material being rolled 12 to cool the material being rolled 12 is sometimes called direct cooling water. Also, the cooling water that is poured onto the rolling equipment (for example, the work rolls 26, the backup rolls 28, and the table rolls of the ROT 32) to cool the rolling equipment is sometimes called indirect cooling water. In the following, in the case where the types of cooling water are distinguished, the terms of direct cooling water and indirect cooling water are used.

On at least one of the entry side and the delivery side of the rolling stands 24 shown in FIG. 1, roll cooling systems 48 are provided. The roll cooling systems 48 can pour the indirect cooling water, which is supplied from the tank 38, onto the work rolls 26 and the backup rolls 28. Also, between the adjacent rolling stands 24, an inter-stand cooling system (ISC: Inter Stand Coolant) 50 is provided. Since the finishing mill 22 usually has five to seven rolling stands 24, four to six inter-stand cooling systems 50 are provided. The inter-stand cooling system 50 can pour the direct cooling water, which is supplied from the tank 38, onto the material being rolled 12 on the table rolls. Also, the ROT 32 is provided with cooling banks 52. Each of the cooling banks 52 is provided with a plurality of ROT water pouring devices 54. The ROT water pouring device 54 can pour the direct cooling water, which is supplied from the tank 38, onto the material being rolled 12 on the table rolls.

Both of the direct cooling water and the indirect cooling water are recovered after being used for cooling and are reused. However, the cooling water having been used contains foreign matters such as iron powders therein, or the temperature thereof has become high. Therefore, the cooling water having been used is returned to the purification/cooling process 40. Thereafter, to use it again as cooling water, it is returned to the cooling water pit 42. When the cooling water is poured, to apply a desired pressure to the cooling water, the cooling water is pumped up to the tank 38 at a high place, and is used again as cooling water. For the movement of water, the pumps 44, the electric motors 46 for driving the pumps 44, and the driving devices for the electric motors 46 are used.

Also, the hot strip rolling mill 10 shown in FIG. 1 has a control unit 60. To the input side of the control unit 60, in addition to the above-described finisher delivery-side pyrometer 30 and coiling pyrometer 34, various types of sensors for detecting the states of the material being rolled 12 and rolling equipment are connected. To the output side of the control unit 60, in addition to the above-described roll cooling systems 48, inter-stand cooling systems 50, ROT water pouring devices 54, driving devices for the pumps 44, and the driving devices capable of changing the rotational speeds of the work rolls 26 (rolling speed), various types of actuators for controlling the states of the material being rolled 12 and rolling equipment are connected. Also, the control unit 60 has a setting function of setting various types of control information (for example, the target temperature of the material being rolled 12) and the like according to the material properties and product specification of the material being rolled 12.

Based on the above-described various types of control information and the outputs of the above-described various types of sensors, the control unit 60 operates the various types of actuators in accordance with the predetermined program to control the states of the material being rolled 12 and rolling equipment.

In the rolling plant as described above, cooling water is generally poured onto a material being rolled to control the temperature thereof to a desired temperature. In the case where cooling water is poured onto a high-temperature material being rolled or cooled to cool the material being rolled, the target temperature after cooling is given, and to meet the target temperature, various types of actuators are controlled. For the hot strip rolling mill 10 shown in FIG. 1, the target of the temperature of the material being rolled 12 on the delivery side of the finishing mill 22 (FDT) is given to the control unit 60, and the control unit 60 carries out finisher delivery temperature control (FDTC: FDT Control) to meet the FDT target temperature. The final control elements of FDTC are the rolling speed and the inter-stand cooling systems 50 installed between the rolling stands 24.

Also, for the hot strip rolling mill 10 shown in FIG. 1, the target of the temperature of the material being rolled 12 at the entry side of the coiler 36 (CT) is given to the control unit 60, and the control unit 60 carries out the coiling temperature control (CTC: CT Control) for controlling CT to meet the CT target temperature. The final control elements of CTC are the ROT water pouring devices 54 installed on the ROT 32 arranged between the finishing mill 22 and the coiler 36.

[Idea of the Present Invention]

Next, explanation is given of the basic idea of the present invention that is common to the embodiments. The basic idea of the present invention is based on the formula described below. Formula (1) represents the heat transfer of water cooling. In this explanation, the heat transfer means the movement of heat energy between the surface of an object to be cooled and cooling water. Heat conduction means the movement of heat energy within an object to be cooled.

[Formula 1]

$$Q_w = -h_w A_w (T_{surf} - T_w) \quad (1)$$

in which $Q_w$: heat flow of surface of object to be cooled [W]

Wherein, the case where heat is lost from object to be cooled, $Q_w$ is made less than zero.

$h_w$: heat transfer coefficient between object to be cooled and cooling water [W/mm$^2$/K]

$A_w$: surface area of object to be cooled [mm$^2$]

$T_{surf}$: surface temperature of object to be cooled [K]

$T_w$: cooling water temperature [K]

In the case where the temperature of the object to be cooled is higher than that of the cooling water, a large absolute value of heat flow calculated from Formula (1) means that the object to be cooled is liable to be cooled. Since the object to be cooled has a volume, the volume is divided into minute ones, and the temperature change $T_i$ of the i-th minute volume portion is expressed by the Formula described below.

[Formula 2]

$$\Delta T_i = \frac{\sum Q_i}{\rho C_p V_i} \Delta t \quad 2$$

in which

ρ: density of object to be cooled [kg/mm$^3$]

$C_P$: specific heat of object to be cooled [J/kg/deg]

$V_i$: i-th minute volume [mm$^3$]

Δt: time change [s]

ΣQ: sum of heat flows. All of the heat flows caused by radiation, air cooling convection, and heat conduction are included besides $Q_w$ in Formula (1). Wherein, the case where heat is lost from object to be cooled, Q is made less than zero.

Figure 2:
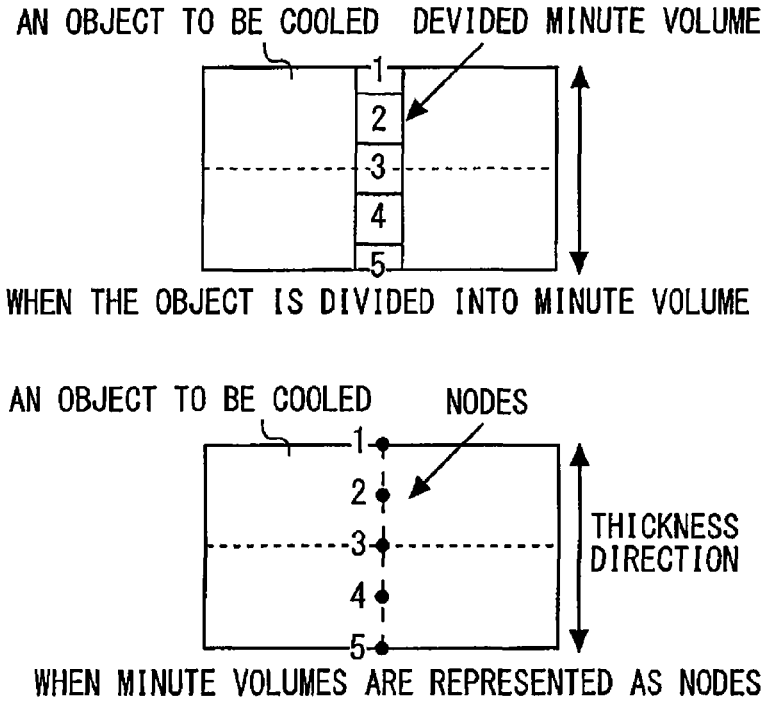
FIG. 2 is an explanatory view for explaining a method of calculation of heat conduction of an object to be cooled.

FIG. 2 shows an example in which the object to be cooled is divided into five minute volumes in the thickness direction. A number is given to each of five minute volumes in sequence such as 1, . . . , 5 from the top surface, and each minute volume is generally represented as i-th. In the difference calculus (one of the methods of numerical analysis for solving a differential equation) used for the calculation of heat, the divided minute volume shown in the upper figure of FIG. 2 is represented by a node (dot) shown in the lower figure of FIG. 2, and the delivery and receipt of heat between the nodes are generally described as in Formula (2). The explanation of the present invention also follows this rule.

From Formulas (1) and (2), since the density and specific heat of the object to be cooled, which are physical properties thereof, and the minute volume cannot be changed, in order to lower the temperature of the object to be cooled, ΣQ has only to be increased. For this purpose, the following methods can be thought of.

(A) To increase the difference between the surface temperature $T_{surf}$ of the object to be cooled and the temperature $T_w$ of the cooling water.

(B) To increase the heat transfer coefficient $h_w$ between the object to be cooled and the cooling water.

(C) To increase the surface area $A_w$ of the object to be cooled.

Concerning item (B), it is known that the heat transfer coefficient depends on the surface temperature and surface state such as an oxide film adhering to the surface of metallic material. Concerning item (C), the surface area increases in the case where the surface of the object to be cooled is not smooth. However, the heat transfer coefficient in item (B) and the surface temperature in item (C) are uncontrollable quantities.

In item (A), the temperature of the cooling water cannot be changed easily because the temperature thereof is realized as the result of cooling process as explained with reference to FIG. 1. On the other hand, the surface temperature of the object to be cooled can be changed by contrivance.

In the case where a unit length and a unit width are taken, the object to be cooled always has a thickness, and has a temperature distribution in the thickness direction. Generally, since the surface is cooled earlier, the interior in the thickness direction has a higher temperature than the surface. Coming-out of the interior heat to the surface depends on the heat conduction of the object to be cooled. The heat conduction is represented by heat conductivity, which is one of physical properties (the heat conduction is a physical property different from the heat transfer).

In order to increase the surface temperature of the object to be cooled, it is necessary to wait until heat is transmitted to the surface by heat conduction from the high-temperature portion in the object to be cooled at a certain time after cooling.

Hereunder, in some cases, the object to be cooled is a metallic material subjected to working by a rolling mill, that is, a material being rolled, and in some cases, the object to be cooled is rolling equipment such as rolling rolls.

In the present invention, based on the above-described idea, in the case where the object to be cooled is a metallic material, the timing when cooling water is poured is determined so that the surface temperature is raised by the heat transmitted from the interior of the object to be cooled. By pouring water at this timing, the cooling efficiency is increased, and thereby the energy-saving effect is enhanced.

Also, in the present invention, in the case where the object to be cooled is rolling equipment, the timing when cooling water is poured is determined so that the surface temperature is raised by the heat transmitted from the interior of the rolling equipment in a so-called idling state in which no material is rolled or the material being rolled is not conveyed. By pouring water at this timing, the cooling efficiency is increased, and thereby the energy-saving effect is enhanced.

Figure 3:
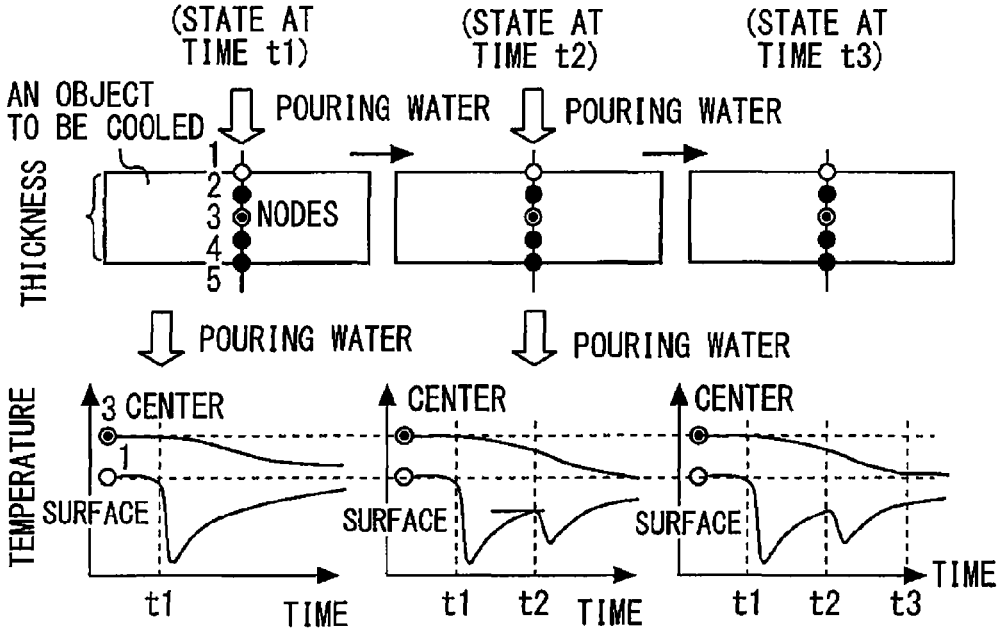
FIG. 3 is an explanatory view for explaining a temperature change in the center temperature and the surface temperature of the object to be cooled in the case where cooling water is poured onto the object to be cooled at time t1 and time t2.
Figure 4:
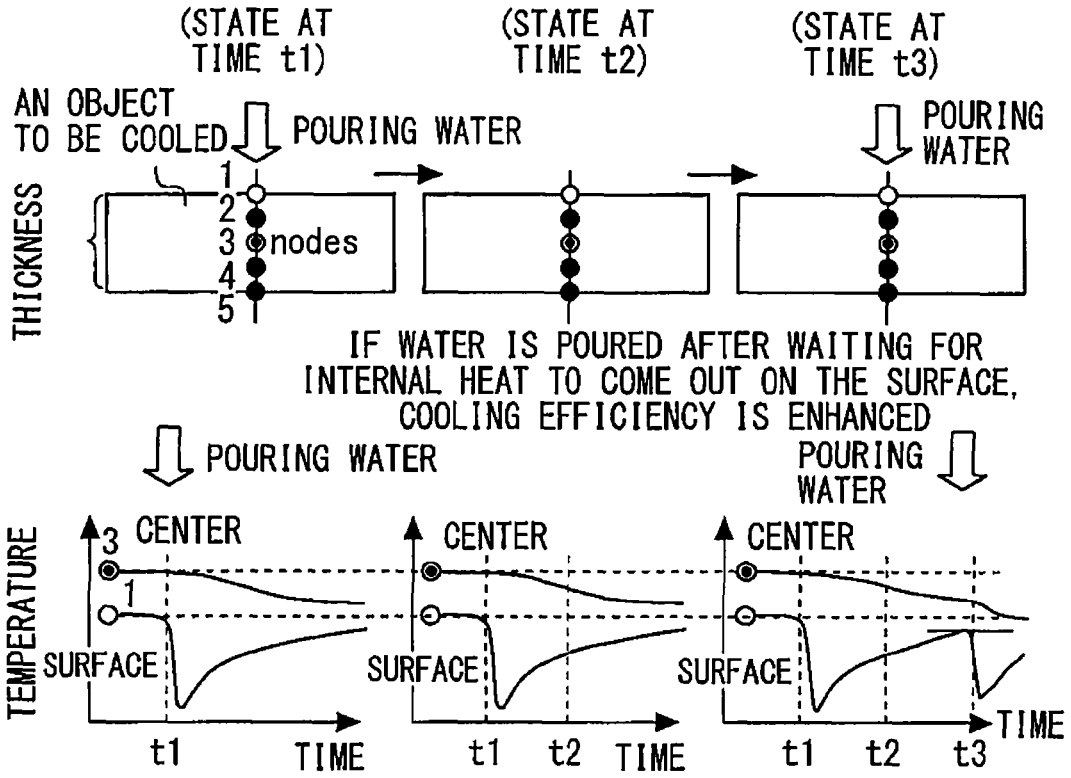
FIG. 4 is an explanatory view for explaining a temperature change in the center temperature and the surface temperature of the object to be cooled in the case where cooling water is poured onto the object to be cooled at time t1 and time t3.

The cooling method in the case where the above-described idea is applied is explained with reference to FIGS. 3 and 4. In FIGS. 3 and 4, it is assumed that the object to be cooled moves linearly or in the rotation direction in the order of the state at time t1, the state at time t2, and the state at time t3. FIG. 3 shows a temperature change in the center temperature (node 3) and the surface temperature (node 1) of the object to be cooled in the case where cooling water is poured onto the object to be cooled at time t1 and time t2. FIG. 4 shows a temperature change in the center temperature (node 3) and the surface temperature (node 1) of the object to be cooled in the case where cooling water is poured onto the object to be cooled at time t1 and time t3.

As shown in FIG. 3, in the case where the object to be cooled is cooled with cooling water, immediately after water has been poured at time t1, the surface temperature of the object to be cooled lowers rapidly. In FIG. 3, cooling water is poured at timing of time t2 just after time t1, so that the object to be cooled is cooled before the heat in the interior comes out to the surface sufficiently. Therefore, the heat flow in Formula (1) decreases, and therefore the cooling efficiency is poor.

On the other hand, as shown in FIG. 4, in the case where water is poured at time t1, and thereafter water is not poured at time t2, the surface temperature rises because the heat within the object to be cooled comes out to the surface. At timing of time t3 shown in FIG. 4, the surface temperature of the object to be cooled rises as compared with the timing of time t2 shown in FIG. 3. Therefore, when water is poured at timing of time t3 as shown in FIG. 4, the heat flow in Formula (1) increases, and therefore the cooling efficiency is enhanced.

In the following, explanation is given of the embodiments based on the above-described basic idea of the present invention.

In first to fourth embodiments, the case where the object to be cooled is the material being rolled 12 is explained. In particular, in the first to third embodiments, the cooling of the material being rolled 12 using the inter-stand cooling systems 50 is explained. In the fourth embodiment, the cooling of the material being rolled 12 using the ROT water pouring devices 54 is explained.

In a fifth embodiment, the case where the object to be cooled is a table roll is explained.

In a sixth embodiment, the case where the object to be cooled is a rolling roll is explained.

First Embodiment

In the conventional FDTC, when the inter-stand cooling systems 50 are operated, the pouring amount of cooling water poured from the inter-stand cooling system 50 for controlling the temperature to the FDT target temperature has been determined without considering the cooling efficiency and the energy-saving effect. In contrast, in the first embodiment of the present invention, when the material being rolled is cooled using the inter-stand cooling systems 50, by pouring cooling water at timing of high cooling efficiency, the pouring amount is reduced, and thereby the energy consumption for the circulation of cooling water is saved.

Figure 5:
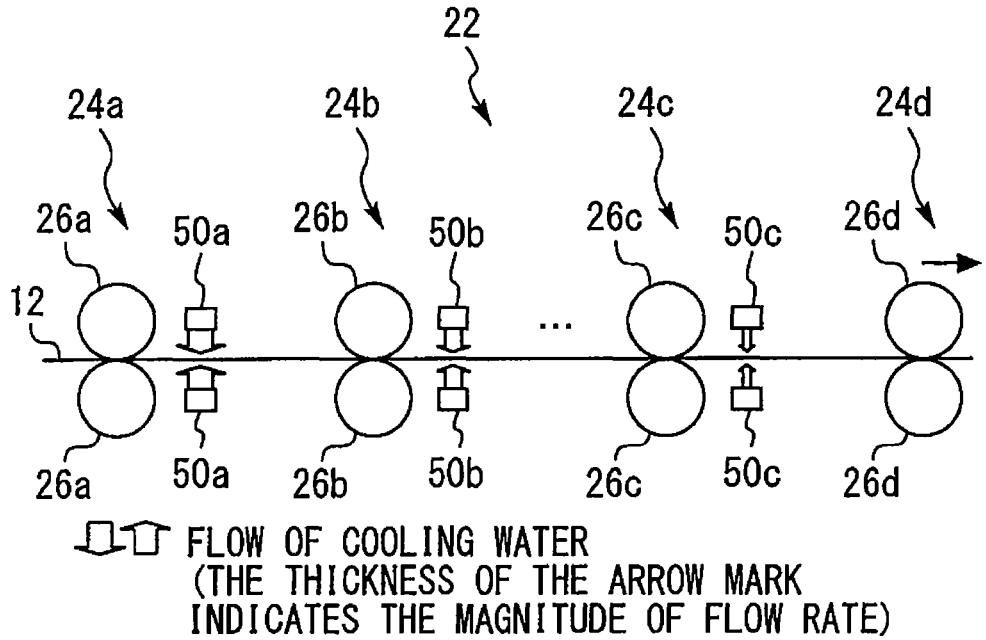
FIG. 5 is an explanatory view for explaining the characteristic configuration in the first embodiment of the present invention.

FIG. 5 is an explanatory view for explaining the characteristic configuration in the first embodiment of the present invention. FIG. 5 is an enlarged view of the finishing mill 22 shown in FIG. 1. The finishing mill 22 is provided with a plurality of rolling stands 24*a* to 24*d* arranged in tandem. In FIG. 5, the material being rolled 12 is rolled in the left-to-right direction. Between the rolling stands, inter-stand cooling systems (ISCs) 50*a* to 50*c* are provided to pour direct cooling water onto the conveyed material being rolled 12. Therefore, the temperature of the material being rolled 12 lowers in the process in which the material being rolled 12 is conveyed to the right-hand side (the downstream side). Since the material being rolled 12 on the left-hand side (the upstream side) has a higher surface temperature, the method in which cooling water is poured from the inter-stand cooling systems 50 on the upstream side to lower the temperature offers higher cooling efficiency as far as the water amount is the same.

In the explanation of the figures given below, in the case where the rolling stands 24*a* to 24*d* are not especially distinguished, these rolling stands are described simply as the rolling stands 24. In the case where the inter-stand cooling systems 50*a* to 50*c* are not especially distinguished, these systems are described simply as the inter-stand cooling systems 50. Also, the number of these apparatuses is not limited to the number shown in the figures.

In this embodiment, in view of the above-described cooling efficiency, the pouring amount of cooling water poured from the inter-stand cooling system 50 is made larger on the upstream side and smaller on the downstream side. That is, in this embodiment, the control unit 60 sets the pouring amount so that the pouring amount of cooling water poured from the inter-stand cooling system 50 positioned on the upstream side on the rolling line is made larger, and the pouring amount of cooling water poured from the inter-stand cooling system 50 positioned on the downstream side is made smaller, within a control range in which the FDT target temperature can be met according to the material properties and the like of the material being rolled 12. In FIG. 5, the outline type arrow mark directed from the inter-stand cooling system to the material being rolled indicates the flow of cooling water, and the thickness of the arrow mark indicates the magnitude of flow rate. As shown in FIG. 5, the control unit 60 sets the pouring amount so that the pouring amount of cooling water poured from the inter-stand cooling system 50*a* positioned on the upstream side is made the largest, and the pouring amount of cooling water decreases toward the downstream side from the inter-stand cooling system 50*b* to the inter-stand cooling system 50*c*.

According to the above-described configuration, as compared with the case where the pouring amounts of cooling water poured from all of the inter-stand cooling systems 50 are made fixed, the flow rate of cooling water required for cooling the material being rolled to the FDT target temperature can be reduced. By enhancing the cooling efficiency and reducing the pouring amount in this manner, the electric energy of the pump and the like for the circulation of cooling water can be saved. Therefore, the energy consumption in rolling can be saved.

Second Embodiment

Figure 6:
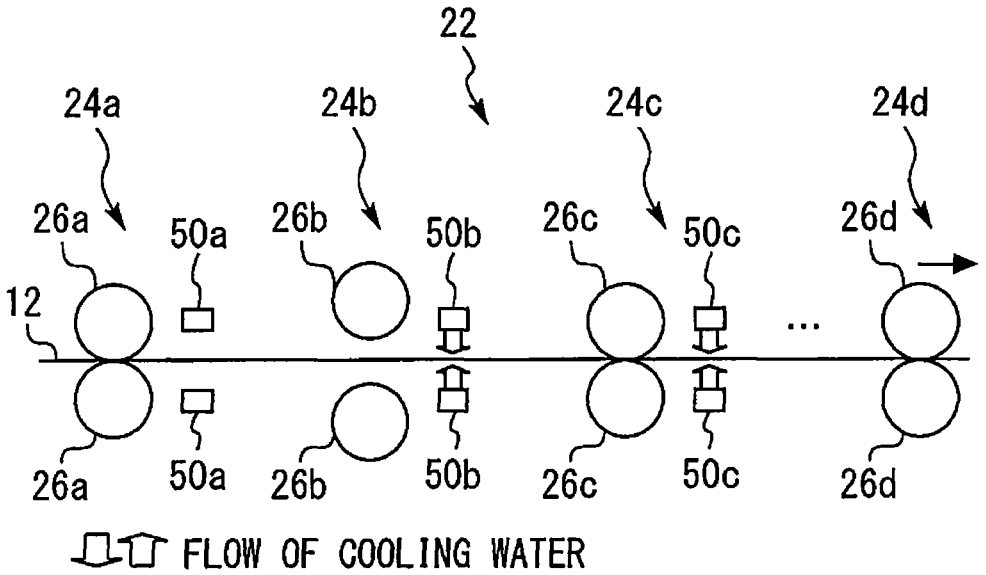
FIG. 6 is an explanatory view for explaining the characteristic configuration in the second embodiment of the present invention.

FIG. 6 is an explanatory view for explaining the characteristic configuration in the second embodiment of the present invention. FIG. 6 is an enlarged view of the finishing mill 22 shown in FIG. 1. The finishing mill 22 is provided with the plurality of rolling stands 24 arranged in tandem. In the explanation given below, the plurality of rolling stands 24 are named a first rolling stand 24*a*, a second rolling stand 24*b*, a third rolling stand 24*c*, . . . in the order from the upstream side on the rolling line. For ease of explanation, herein, the rolling stand 24 located at the uppermost upstream position of the finishing mill 22 is named the first rolling stand 24*a*. However, the present invention is not limited to this. For example, the rolling stand 24 located at a position other than the uppermost upstream position may be named the first rolling stand 24*a*. The first rolling stand 24*a* is provided with work rolls 26*a*, the second rolling stand 24*b* is provided with work rolls 26*b*, and the third rolling stand 24*c* is provided with work rolls 26*c*. In the explanation below, in the case where the work rolls 26*a* to 26*c* are not especially distinguished, these work rolls are described simply as the work rolls 26.

For each of the rolling stands 24, an operation mode in which the work rolls 26 are brought into contact with the material being rolled 12 and are used for rolling and an operation mode in which the work rolls 26 are not brought into contact with the material being rolled 12 and are not used for rolling can be changed over between one mode and the other mode. Which operation mode is set for each of the rolling stands 24 is determined by the control unit 60 according to the material properties, product specification, and the like of the material being rolled 12. Also, between the adjacent rolling stands 24, the inter-stand cooling system (ISC) 50 is provided. In FIG. 6, between the first rolling stand 24*a* and the second rolling stand 24*b*, a first inter-stand cooling system 50*a* is provided, and between the second rolling stand 24*b* and the third rolling stand 24*c*, a second inter-stand cooling system 50*b* is provided.

FIG. 6 shows the case where the second rolling stand 24*b* is a dummy, that is, in the operation mode in which the work rolls 26*b* are not used for rolling. Any rolling stand may be a dummy; however, in this example, the second rolling stand 24*b* is made a dummy. When the material being rolled 12 is rolled by the rolling stand 24*a*, the heat of the material being rolled 12 is also lost by the work rolls 26*a*. Therefore, immediately after the material being rolled 12 has passed through the rolling stand 24*a*, the surface temperature of the material being rolled 12 lowers. By the heat recuperation effect, as the material being rolled 12 advances to the rolling stands 24*b* and 24*c*, the surface temperature of the material being rolled 12 rises. Therefore, the method in which cooling water is poured from the second inter-stand cooling system 50*b*, not from the first inter-stand cooling system 50*a*, offers higher cooling efficiency as far as the pouring amount is the same.

Accordingly, in this embodiment, in the state in which the first rolling stand 24*a* is used for rolling and the second rolling stand 24*b* is not used for rolling, cooling water is not poured from the first inter-stand cooling system 50*a*, and cooling water is poured from the second inter-stand cooling system 50*b*.

FIG. 7 is a flowchart of a control routine executed by the control unit 60 to realize the above-described action. On the premise, the control unit 60 can determine, according to the material properties and product specification of the material being rolled 12, whether all of the rolling stands are used for rolling or some thereof are used for rolling. In this embodiment, in the case where either one of the rolling stands 24*a* and 24*b* is used for rolling, the rolling stand 24*a* is used for rolling. Also, FDTC is carried out, and the routine shown in FIG. 7 is executed within the control range in which the FDT target temperature can be met.

In the routine shown in FIG. 7, first, it is determined whether or not the first rolling stand 24*a* is in the operation mode in which it is used for rolling (Step S100). If the first rolling stand 24*a* is in the operation mode in which it is used for rolling, next, it is determined whether or not the second rolling stand 24*b* is in the operation mode in which it is not used for rolling (Step S110). If the second rolling stand 24*b* is in the operation mode in which it is not used for rolling, the control unit 60 prohibits the first inter-stand cooling system 50*a* from pouring cooling water onto the material being rolled 12 (Step S120). In addition, the control unit 60 permits the second inter-stand cooling system 50*b* to pour cooling water onto the material being rolled 12 (Step S130).

On the other hand, if the first rolling stand 24*a* is in the operation mode in which it is used for rolling in the processing of Step S110, the control unit 60 permits both of the first inter-stand cooling system 50*a* and the second inter-stand cooling system 50*b* to pour cooling water onto the material being rolled 12 (Steps S140 to S150).

According to the above-described configuration, in the case where there is a rolling stand that is not used for rolling, cooling water can be poured at timing of high cooling efficiency, so that the flow rate of cooling water required for cooling the material being rolled to the FDT target temperature can be reduced. By enhancing the cooling efficiency and reducing the pouring amount in this manner, the electric energy of the pump and the like for the circulation of cooling water can be saved. Therefore, the energy consumption in rolling can be saved.

The control of the second embodiment can be applied to the above-described configuration of the first embodiment. That is, in the state in which the first rolling stand 24*a* and the second rolling stand 24*b* roll the material being rolled 12, the control unit 60 permits the first inter-stand cooling system 50*a* and the second inter-stand cooling system 50*b* to pour cooling water, and also the finishing mill 22 may be further provided with a pouring ratio setting means for setting the pouring amount of cooling water poured from the second inter-stand cooling system 50*b* so as to be smaller than the pouring amount of cooling water poured from the first inter-stand cooling system 50*a*.

Third Embodiment

Figure 8:
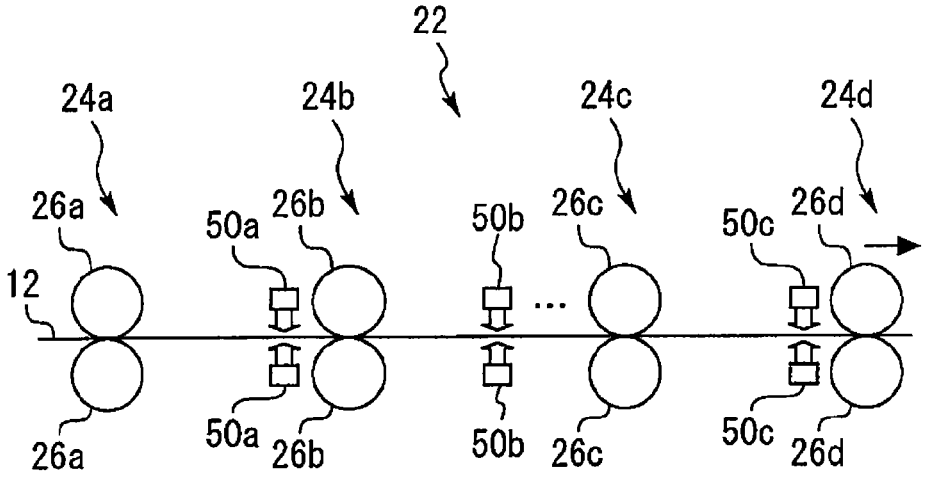
FIG. 8 is an explanatory view for explaining the characteristic configuration in the third embodiment of the present invention.

FIG. 8 is an explanatory view for explaining the characteristic configuration in the third embodiment of the present invention. FIG. 8 is an enlarged view of the finishing mill 22 shown in FIG. 1. The configuration shown in FIG. 8 is basically the same as the configurations shown in FIGS. 5 and 6; however, this configuration is different in that the arrangement of the inter-stand cooling systems 50 is contrived. For example, in the case where the material being rolled 12 is rolled by the rolling stand 24*a*, the heat of the material being rolled 12 is also lost by the work rolls 26*a*. Therefore, immediately after the material being rolled 12 has passed through the rolling stand 24*a*, the surface temperature of the material being rolled 12 lowers. If cooling water is poured after the surface temperature of the material being rolled 12, which has been lowered by the contact with the work rolls 26*a*, has been raised by heat recuperation, the cooling efficiency can be enhanced.

Accordingly, in this embodiment, the inter-stand cooling system 50*a* is installed at a position close to the entry side of the rolling stand 24*b* on the downstream side, not at the position on the delivery side of the rolling stand 24*a* on the upstream side. The same holds true for other inter-stand cooling systems 50.

As shown in FIG. 5 or 6, generally, the inter-stand cooling systems 50 are installed just behind the delivery side (just the downstream side) of the rolling stands 24. In this embodiment, however, the inter-stand cooling systems 50 are installed on the entry side of the rolling stands 24 on the downstream side. By doing this, cooling water is poured after the surface temperature of the material being rolled 12, which has been lowered by the contact with the work rolls 26, has been raised by heat recuperation, so that the cooling efficiency can be enhanced. By the enhancement of the cooling efficiency, the pouring amount can be reduced, and the electric energy of the pump and the like for the circulation of cooling water can be saved. Therefore, the energy consumption in rolling can be saved.

The configuration of the third embodiment can be applied to the above-described configuration of the first or second embodiment. That is, in the configuration of the first or second embodiment, the inter-stand cooling systems 50 may be installed at positions close to the entrance side of the rolling stands 24 on the downstream side, not on the delivery side of the rolling stands 24 on the upstream side.

Fourth Embodiment

In the CTC, in the case where the ROT water pouring devices 54 of the ROT 32 are operated, the cooling pattern of the material being rolled 12 is sometimes determined from the viewpoint of the assurance of material properties such as strength or ductility. For example, former-stage cooling method in which cooling water is poured on the upstream side of the ROT 32 for cooling, latter-stage cooling method in which cooling water is poured on the downstream side thereof, and the like methods are available. For the material required to have material properties of stringent standard, it is necessary to control the cooling pattern and also to control the temperature history during the cooling process. In the other cases, however, the standard of the material properties is not so stringent. In this case, conventionally, only the target value of CT, which is the temperature of the delivery side of the ROT 32, has been controlled. In contrast, in this embodiment, at the time when the material not required to have material properties of stringent standard is cooled using the ROT water pouring devices 54, cooling water is poured at timing of high cooling efficiency, whereby the pouring amount is reduced, and the energy consumption for the circulation of cooling water is saved.

Figure 9:
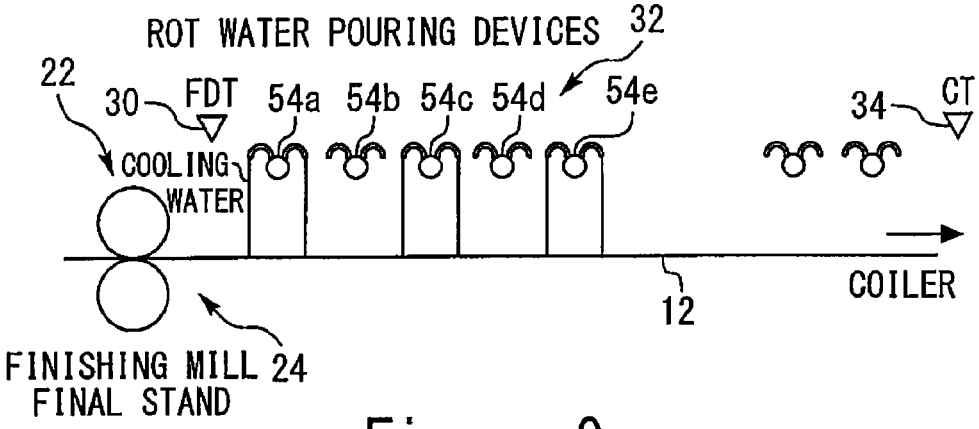
FIG. 9 is an explanatory view for explaining the characteristic configuration in the fourth embodiment of the present invention.

FIG. 9 is an explanatory view for explaining the characteristic configuration in the fourth embodiment of the present invention. FIG. 9 is an enlarged view of the ROT 32 shown in FIG. 1. On the ROT 32, a plurality of ROT water pouring devices 54*a*, 54*b*, 54*c*, . . . are continuously arranged from the delivery side of the final rolling stand 24 of the finishing mill 22 toward the coiler 36 (not shown in FIG. 9). In the explanation given below, in the case where the ROT water pouring devices 54*a*, 54*b*, 54*c*, . . . are not especially distinguished, these water pouring devices are described simply as the ROT water pouring devices 54.

In the above-described FDTC, the above-described inter-stand cooling systems 50 are operated so that the temperature measured by using the finisher delivery-side pyrometer 30 is caused to coincide with the target value (the FDT target temperature). In CTC, the ROT water pouring devices 54 are operated so that the temperature measured by using the coiling pyrometer 34 is caused to coincide with the target value (the CT target temperature). In the method for operating the ROT water pouring devices 54 under CTC, however, for example, if cooling water is poured continuously using the ROT water pouring devices 54*a*, 54*b*, 54*c*, 54*d*, 54*e*, . . . , the surface temperature of the material being rolled 12 is not raised sufficiently by heat recuperation, and the cooling effect of cooling water decreases in the order of 54*b*, 54*c*, . . . .

Accordingly, in this embodiment, of the continuous ROT water pouring devices 54, the ROT water pouring devices 54 for pouring cooling water are installed with one or more intervals being provided.

Figure 10:
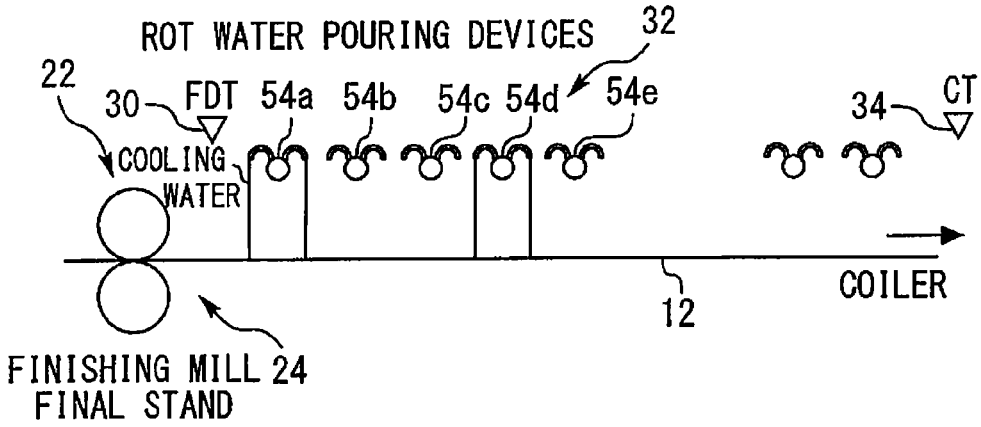
FIG. 10 is a schematic view showing another mode of the fourth embodiment of the present invention.

As shown in FIG. 9, by cooling the material being rolled 12 by using the ROT water pouring devices 54*a*, 54*c*, 54*e*, . . . , which are arranged with intervals being provided therebetween, heat is recuperated and the surface temperature of the material being rolled 12 is raised during the time when the material being rolled 12 goes from 54*a* to 54*c*, and the cooling effect is enhanced as far as the water amount is the same. FIG. 10 is a schematic view showing another mode of the fourth embodiment of the present invention. As shown in FIG. 10, if the intervals of the ROT water pouring devices 54 are increased, the cooling effect is further enhanced.

In an experiment using actual cooling devices as well, taking the cooling efficiency at the time when cooling water is poured continuously such as 54*a*, 54*b*, 54*c*, . . . as 1, when cooling water is poured by using every second device such as 54*a*, 54*c*, 54*e*, . . . as shown in FIG. 9, the cooling efficiency is 1.5, and when cooling water is poured by using every third device such as 54*a*, 54*d*, . . . as shown in FIG. 10, the cooling efficiency is 1.8. However, in the case where there is imposed a restriction, in terms of the material properties of the material being rolled 12, such that cooling water must be poured from the ROT water pouring devices 54 arranged continuously, the quality must be given priority over energy saving.

Figure 11:
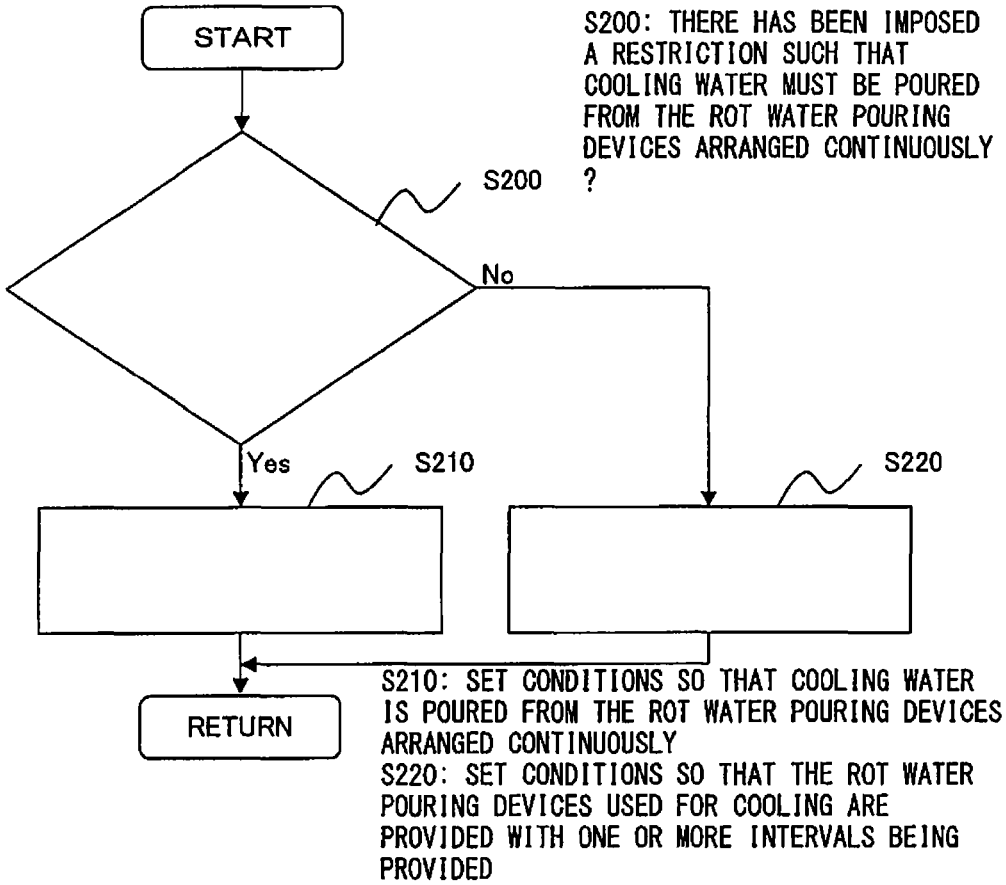
FIG. 11 is a flowchart of a control routine executed by the control unit according to realize the fourth embodiment of the present invention.

FIG. 11 is a flowchart of a control routine executed by the control unit 60 to realize the above-described action. In the routine shown in FIG. 7, first, the control unit 60 determines whether or not there has been imposed a restriction such that cooling water must be poured from the ROT water pouring devices 54*a*, 54*b*, 54*c*, . . . arranged continuously (Step S200). When the operation of the rolling plant is started, the control unit 60 sets a restriction imposition flag according to the material properties and the like of the material being rolled 12. For example, in the case where the material being rolled 12 is a material required to have material properties of stringent standard, the restriction imposition flag is set ON. In Step S200, based on the ON/OFF state of restriction imposition flag, the presence or absence of the restriction can be determined.

If there has been imposed the restriction that cooling water must be poured from the ROT water pouring devices 54 arranged continuously, next, the control unit 60 sets conditions so that cooling water is poured from the ROT water pouring devices 54 arranged continuously (Step S210).

On the other hand, if it is determined in Step S200 that the restriction has not been imposed, next, the control unit 60 sets conditions so that, of the ROT water pouring devices 54, the ROT water pouring devices used for cooling are provided with one or more intervals being provided (Step S220).

According to the above-described configuration, in the case where the material being rolled 12 is not a material required to have material properties of stringent standard, the flow rate of cooling water required for cooling the material being rolled 12 to the CT target temperature can be reduced. By enhancing the cooling efficiency and reducing the pouring amount in this manner, the electric energy of the pump and the like for the circulation of cooling water can be saved. Therefore, the energy consumption in rolling can be saved.

Fifth Embodiment

In the fifth embodiment, the control for cooling the table rolls is explained. The table rolls for conveying the high-temperature material being rolled are cooled by pouring the indirect cooling water to prevent the rolls from becoming at a high temperature and being deformed. Certainly, in the state in which the material being rolled is conveyed, cooling water must be poured always. However, even in the so-called idling state in which the material being rolled is not conveyed, conventionally, the table rolls have been cooled with a certain amount of water without considering how efficiently the rolls are cooled. In contrast, in the control of this embodiment, in the idling state, the indirect cooling water is poured from the ROT water pouring devices 54 at timing of high cooling efficiency, whereby the pouring amount is reduced, and the energy consumption for the circulation of cooling water is saved.

Figure 12:
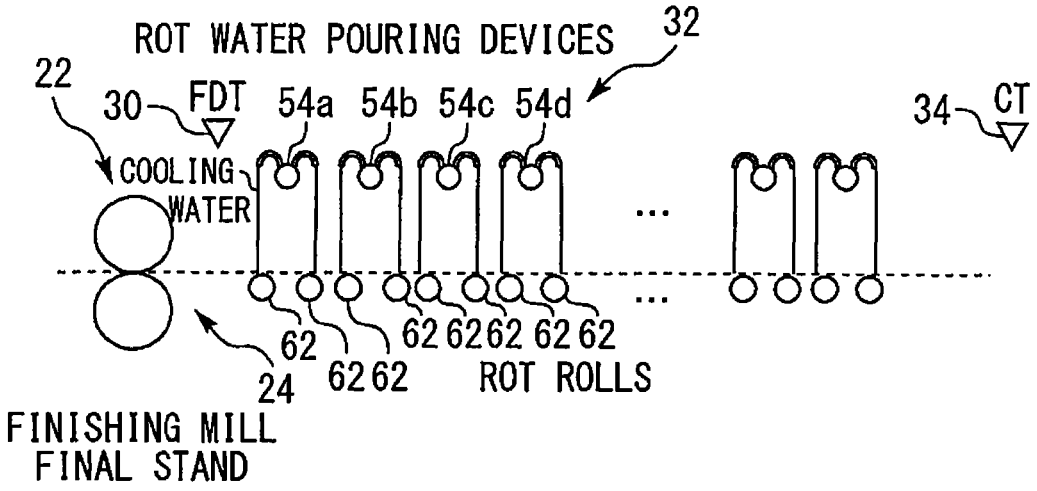
FIG. 12 is an explanatory view for explaining the characteristic configuration in the fifth embodiment of the present invention.

FIG. 12 is an explanatory view for explaining the characteristic configuration in the fifth embodiment of the present invention. FIG. 12 is an enlarged view of the ROT 32 shown in FIG. 1. The configuration shown in FIG. 12 is basically the same as the configurations described with reference to FIGS. 9 and 10; however, FIG. 12 shows table rolls 62 for conveying the material being rolled 12 from the upstream side on the rolling line (the left-hand side of FIG. 12) to the downstream side (the right-hand side of FIG. 12). Also, FIG. 12 shows the idling state in which the material being rolled 12 is not conveyed by the table rolls 62. The ROT 32 is provided with a large number of table rolls 62 for conveying the material being rolled 12. Also, the ROT water pouring devices 54 are arranged so that cooling water can be poured toward the table rolls 62 in the state in which the material being rolled 12 is not being conveyed on the table rolls 62.

In some cases, the control unit 60 cools the table rolls 62 by pouring cooling water all together from the ROT water pouring devices 54 after the material being rolled 12 has passed through so as to protect the table rolls 62 themselves and to prevent an influence from being exerted on the temperature of the next cooled material being rolled 12. In this case, the pouring of cooling water all together from the ROT water pouring devices 54 does not continue, for example, for five seconds, but cooling water is first poured all together for two seconds, the pouring being stopped for n seconds, and cooling water is again poured all together for two seconds. This is a method in which during the stopping time of n seconds, the heat stored within the roll comes out to the roll surface, whereby the surface temperature is raised, cooling water is poured at this time, whereby the cooling efficiency is enhanced, and resultantly the total water pouring time is shortened from five seconds to four seconds. The stopping time of n seconds is made as long as possible while considering the time at which the next material comes.

That is, in this embodiment, in the idling state in which the material being rolled is not conveyed by the table rolls 62, cooling water is poured intermittently from the ROT water pouring devices 54 toward the table rolls 62.

Figure 13:
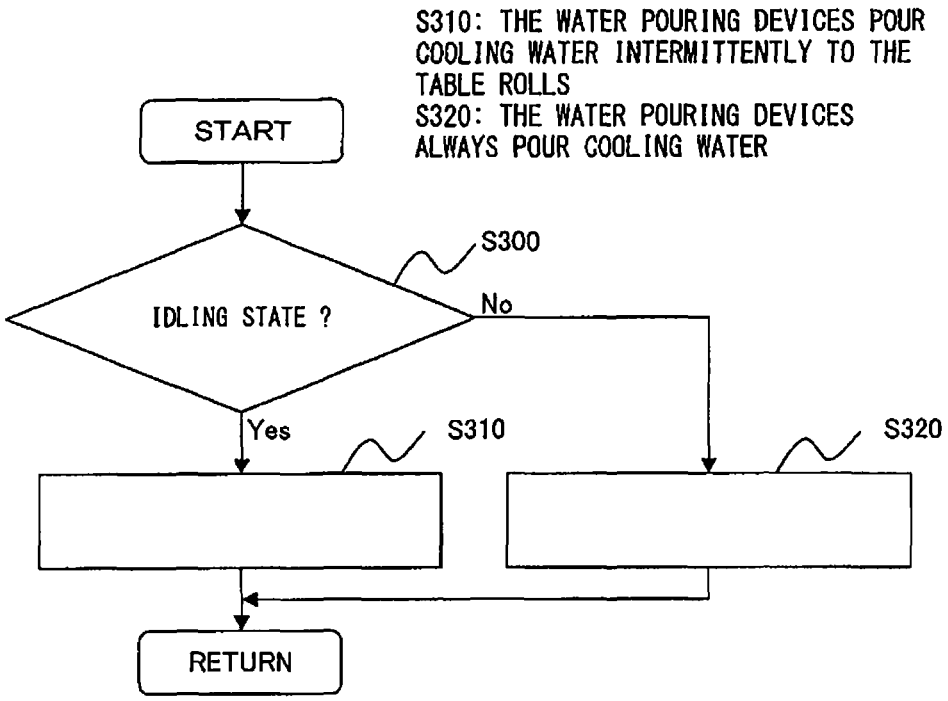
FIG. 13 is a flowchart of a control routine executed by the control unit according to the fifth embodiment of the present invention.

FIG. 13 is a flowchart of a control routine executed by the control unit 60 to realize the above-described action. In the routine shown in FIG. 13, first, it is determined whether there is formed an idling state in which the material being rolled 12 is not being conveyed on the table rolls 62 (Step S300).

If there is formed the idling state in which the material being rolled 12 is not being conveyed on the table rolls 62, the control unit 60 pours cooling water intermittently from the ROT water pouring devices 54 (Step S310). Specifically, as described above, cooling water is first poured all together for two seconds, the pouring being stopped for n seconds, and cooling water is again poured all together for two seconds.

On the other hand, if the idling state is not formed, that is, the state is such that the material being rolled 12 is conveyed by the table rolls, the control unit 60 causes the ROT water pouring devices 54 to always pour cooling water (Step S320).

Figure 14:
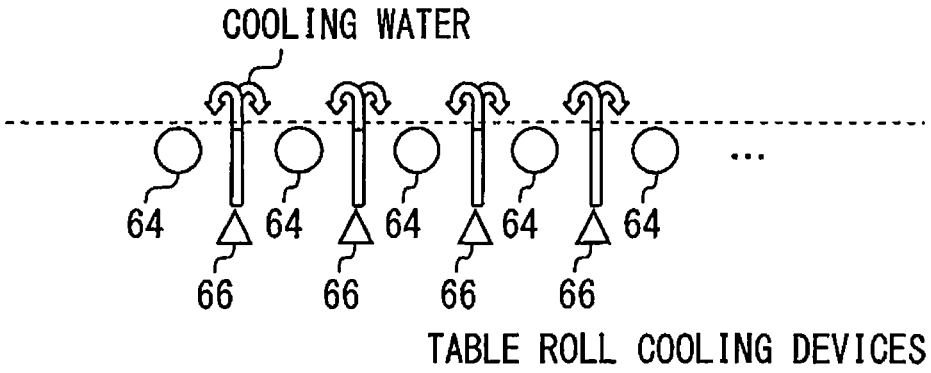
FIG. 14 is an explanatory view for explaining another mode of the fifth embodiment of the present invention.

FIG. 14 is an explanatory view for explaining another mode of the fifth embodiment of the present invention. Generally, on the rolling line, table rolls 64 for conveying a material are installed at many places, not limited to the ROT 32 shown in FIG. 12. FIG. 14 generalizedly shows the table rolls 64. Between the table rolls 64, table roll cooling devices 66 are arranged. The table roll cooling devices 66 pour cooling water to cool the table rolls 64 during the time when the material being rolled is being conveyed and for a certain time period after the material being rolled has been conveyed. The table roll cooling devices 66 are connected to the output side of the control unit 60.

In this case as well, as explained with reference to FIG. 12, after the material being rolled 12 has been conveyed, cooling water is not poured continuously, but the water pouring operation and the no water pouring operation are repeated with a certain time period being provided therebetween, whereby the cooling efficiency is enhanced. During the time when the material being rolled 12 is conveyed, cooling water is always poured because the quantity of heat received from the material being rolled is large.

According to the configuration of this embodiment, in the case where the material being rolled 12 is not conveyed by the table rolls 62 or 64, the flow rate of cooling water required for cooling the table rolls 62 or 64 can be reduced. By enhancing the cooling efficiency and reducing the pouring amount in this manner, the electric energy of the pump and the like for the circulation of cooling water can be saved. Therefore, the energy consumption in rolling can be saved.

Sixth Embodiment

In the sixth embodiment, the control for cooling the rolling rolls is explained. Generally, in the case where high-temperature material being rolled is rolled by the rolling rolls, the roll temperature is raised by the heat transmitted from the material being rolled, and thermal expansion occurs. Therefore, to suppress the thermal expansion, or to protect the roll, the roll is cooled. During rolling, cooling water must be poured always. On the other hand, in the idling state in which the material being rolled is not rolled, the pouring amount of cooling water is sometimes increased or decreased.

In the sixth embodiment of the present invention, in the idling state, while considering the restriction of cooling water amount for cooling the rolling roll to within the upper limit of roll temperature, the number or rotations of rolling roll and the cooling water amount of rolling roll are determined so that the sum of the energy consumption for rotating the rolling roll and the energy consumption for pouring cooling water for cooling the rolling roll is at a minimum. To make the heat existing within the rolling roll easy to come out to the surface, the roll is rotated slowly, whereby the time interval of cooling using cooling water and the efficiency due to the rotational speed of roll are balanced properly.

Figure 15:
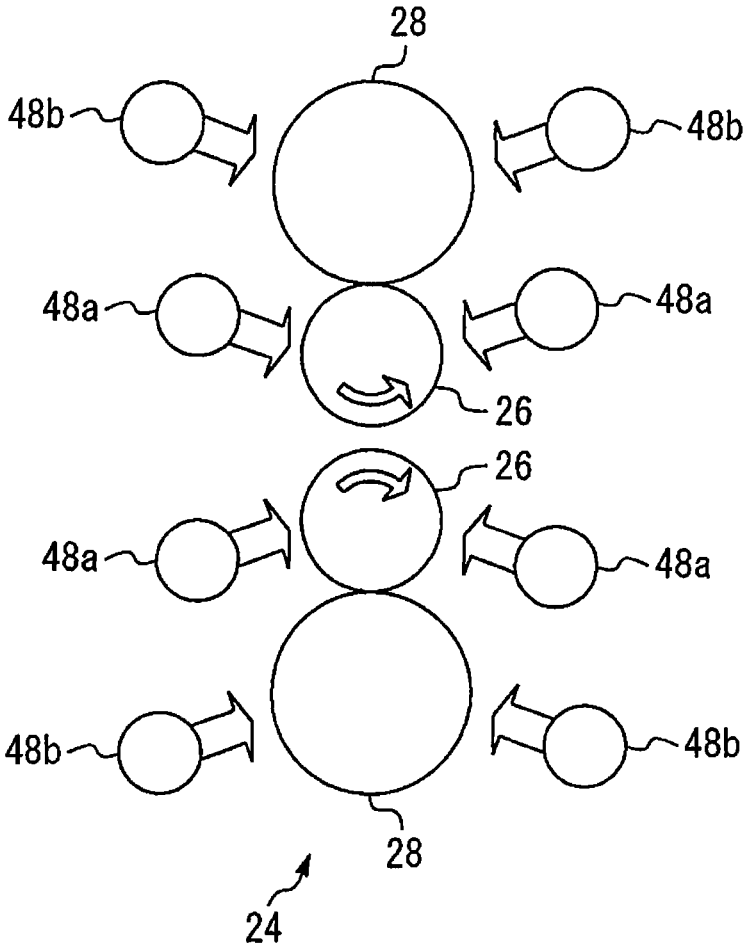
FIG. 15 is an explanatory view for explaining the characteristic configuration in the sixth embodiment of the present invention.

FIG. 15 is an explanatory view for explaining the characteristic configuration in the sixth embodiment of the present invention. FIG. 15 is an enlarged view of the rolling stand 24 shown in FIG. 1. As described above, the rolling stand 24 includes the work rolls (WRs: Work Rolls) 26, which are rolling rolls, the backup rolls (BURs: Back Up Rolls) 28, and the roll cooling systems 48. The roll cooling systems 48 are installed on both of the entry and delivery sides of the rolling stand 24. Specifically, the roll cooling system 48 is composed of a WR cooling system 48*a* for pouring indirect cooling water onto the work roll 26 and a BUR cooling system 48*b* for pouring indirect cooling water onto the backup roll 28. In the explanation given below, in the case where the cooling systems 48*a* and 48*b* are not especially distinguished, these cooling systems are described simply as the roll cooling systems 48. Also, the indirect cooling water poured from the roll cooling system 48 is called roll cooling water.

Figure 16:
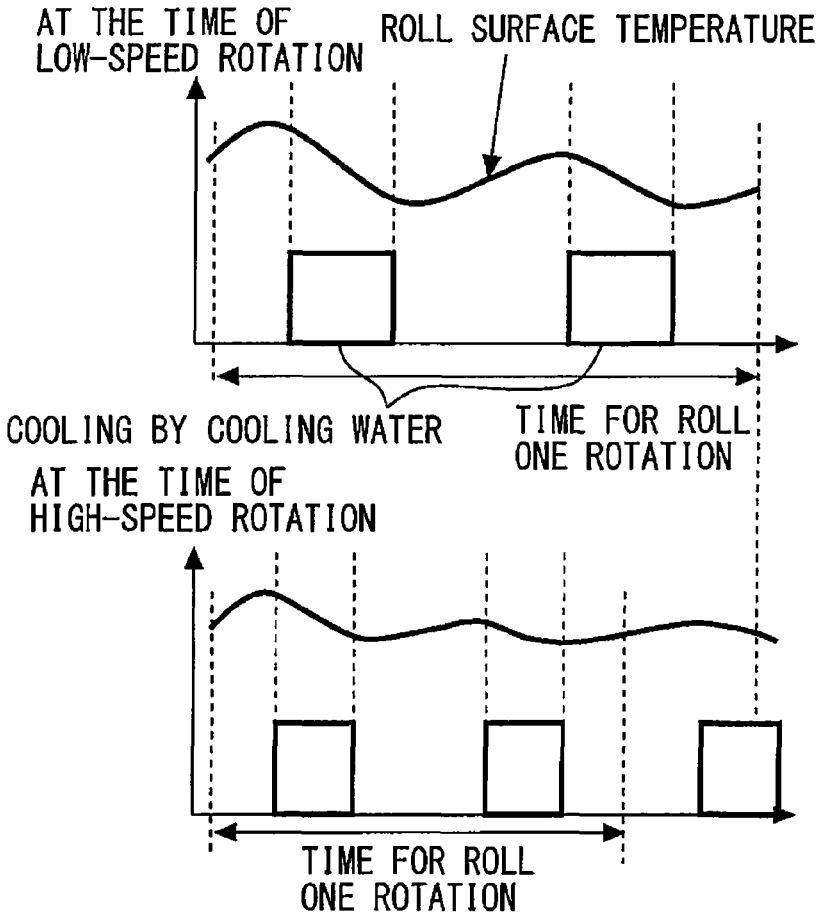
FIG. 16 is diagrams for explaining the change in roll surface temperature in a predetermined portion of the surface of the work roll.

FIG. 16 is diagrams for explaining the change in roll surface temperature in a predetermined portion of the surface of the work roll 26. As shown in FIG. 15, on to the work roll 26, cooling water is poured from the WR cooling systems 48*a* provided at two places. Therefore, the predetermined portion is cooled two times on one rotation of roll. The upper diagram of FIG. 16 shows the relationship between the time during which the cooling water hits the work roll 26 and the change in roll surface temperature at the time when the work roll 26 is rotated at a low speed. The lower diagram of FIG. 16 shows the relationship between the time during which the cooling water hits the work roll 26 and the change in roll surface temperature at the time when the work roll 26 is rotated at a high speed.

As shown in FIG. 16, at the time of low-speed rotation, the time during which the cooling water hits the roll surface is longer than that at the time of high-speed rotation, and the time up to the next hitting of cooling water is also longer. Therefore, a margin time for the heat within the work roll to come out to the surface can be provided. As the result, the surface temperature of roll becomes high, and the work roll can be cooled more efficiently.

Figure 17:
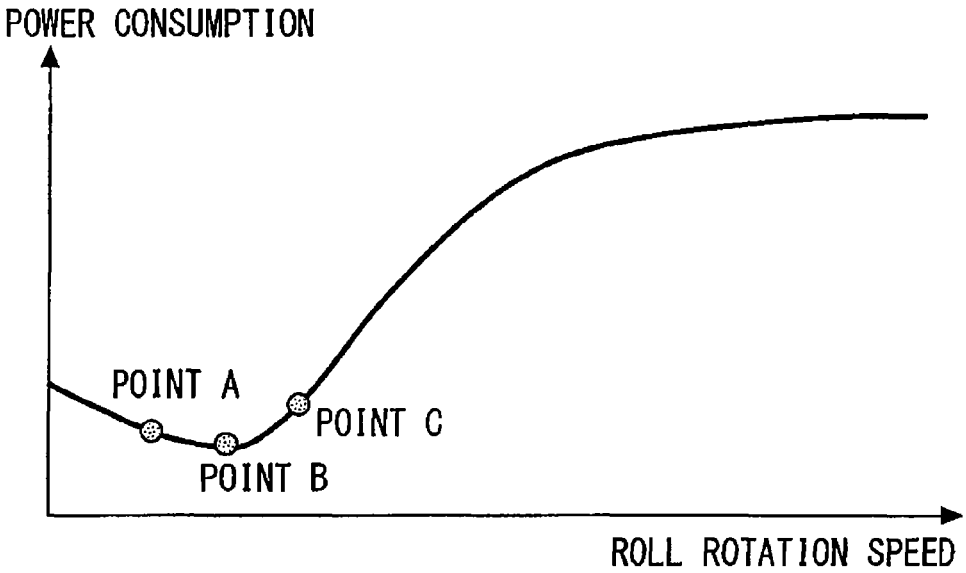
FIG. 17 is a graph for explaining the characteristic configuration in the sixth embodiment of the present invention.

FIG. 17 is a graph for explaining the characteristic configuration in the sixth embodiment of the present invention. The above explanation with reference to FIG. 16 reveals that low-speed rotation is preferable. However, considering the efficiency of electric motor for rotating the roll, the loss of a roll machinery system, and the like, a lower speed does not necessarily lead to energy saving. FIG. 17 briefly shows the relationship between the roll rotation speed and the power consumption. Generally, if the rotation speed of the electric motor is small, the efficiency thereof becomes poor. Also, in the case where solid fat such as grease is used for bearings, at the time of low-speed rotation, the roll machinery system connected to the electric motor has a lot of resistance on account of adhesiveness. Therefore, the power consumption curve as shown in FIG. 17 is sometimes obtained. In this case, under the conditions of points A, B and C, the power consumption of electric motor for driving the rolls and the electric energy of pump for supplying roll cooling water at respective three points are predictingly calculated, an operation point in the case where the sum of the power consumption of electric motor for driving the rolls and the electric energy of pump for supplying roll cooling water is at a minimum is selected from any of points A, B and C, and the operation is performed at this point.

Figure 18:
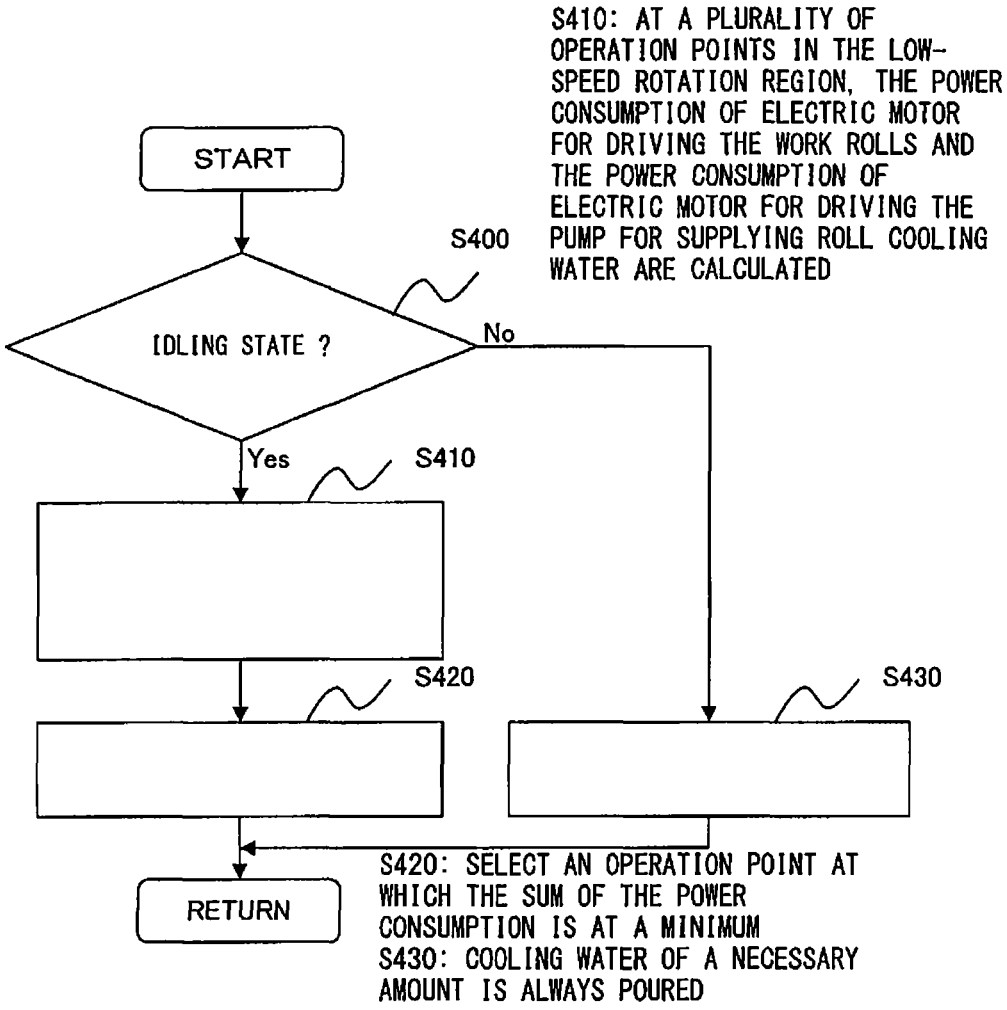
FIG. 18 is a flowchart of a control routine executed by the control unit according to the sixth embodiment of the present invention.

FIG. 18 is a flowchart of a control routine executed by the control unit 60 to realize the above-described action. In the routine shown in FIG. 18, first, it is determined whether there is formed an idling state in which the material being rolled 12 is not being rolled by the work rolls 26, which are the rolling rolls (Step S400).

If there is formed the idling state in which the material being rolled 12 is not being rolled by the work rolls 26, the control unit 60 operates the work rolls 26 in a low-speed rotation region. In addition, at a plurality of operation points (for example, three different roll rotation speed indicated by points A, B and C in FIG. 17) in the low-speed rotation region, the power consumption of electric motor for driving the work rolls 26 and the power consumption of electric motor for driving the pump for supplying roll cooling water are calculated (Step S410). The electric energies at the plurality of operation points may be measured and stored in advance.

Next, the control unit 60 selects an operation point at which the sum of the power consumption of electric motor for driving the work rolls 26 and the power consumption of pump for supplying roll cooling water are at a minimum (Step S420). Thereafter, the control unit 60 operates the work rolls 26 at the selected operation point (the roll rotation speed).

On the other hand, if it is determined in Step S400 that the idling state is not formed, the control unit 60 causes the roll cooling systems 48 to always pour cooling water of a necessary amount (Step S430).

According to the above-described configuration, in the case where the material being rolled is not being rolled by the rolling rolls, while the cooling efficiency are enhanced, the sum of the power consumption of electric motor for driving the work rolls and the power consumption of electric motor for driving the pump for supplying roll cooling water can be made at a minimum. Considering the energy for rotating the rolling rolls as well, cooling can be performed with high efficiency, and therefore the total energy consumption can be saved.

REFERENCE SIGNS LIST

10 hot strip rolling
12 material being rolled
14 heating furnace
16, 20 scale breaker
18 roughing mill
22 finishing mill
24, 24*a*-24*d* rolling stand
26, 26*a*-26*d* work roll
28 backup roll
30 finisher delivery-side pyrometer
32 run out table (ROT)
34 coiling pyrometer
36 coiler
38 tank
40 purification/cooling process
42 cooling water pit
44 pump
46 electric motor
48 roll cooling system
48*a* WR cooling system
48*b* BUR cooling system
50, 50*a*-50*c* inter-stand cooling system (ISC)
52 cooling bank
54, 54*a*-54*e* ROT water pouring device
60 control unit
62, 64 table roll
66 table roll cooling device

The invention claimed is:

1. An energy-saving device for a rolling plant, comprising:

a first rolling stand for rolling the material being rolled of a metallic material conveyed on a rolling line;

a second rolling stand arranged on the downstream side of the first rolling stand;

a third rolling stand arranged on the downstream side of the second rolling stand;

a first inter-stand cooling system which is provided between the first rolling stand and the second rolling stand to pour cooling water onto the conveyed material being rolled;

a second inter-stand cooling system which is provided between the second rolling stand and the third rolling stand to pour cooling water onto the conveyed material being rolled; and a controller configured to:

change an operating mode of the rolling plant from a state in which the second rolling stand rolls the material being rolled and a state in which the second rolling stand does not roll the material being rolled according to a product specification of the material being rolled; and prohibit the first inter-stand cooling system from pouring cooling water and permit the second inter-stand cooling system to pour cooling water in a state in which the first rolling stand and the third rolling stand roll the material being rolled and the second rolling stand does not roll the material being rolled.

* * * * *